United States Patent [19]

Osawa

[11] Patent Number: 4,863,820

[45] Date of Patent: Sep. 5, 1989

[54] PHOTOSENSITIVE MEMBER HAVING AMORPHOUS SILICON-GERMANIUM LAYER AND PROCESS FOR PRODUCING SAME

[75] Inventor: Izumi Osawa, Ikeda, Japan

[73] Assignee: Minolta Camera Kabushiki Kaisha, Osaka, Japan

[21] Appl. No.: 880,675

[22] Filed: Jun. 30, 1986

[30] Foreign Application Priority Data

Jul. 1, 1985 [JP] Japan ..... 60-145005

[51] Int. Cl.[4] ..... G03G 5/082; G03G 5/14

[52] U.S. Cl. ..... 430/58; 430/57; 430/65; 430/66; 430/67; 430/95

[58] Field of Search ..... 430/57, 58, 63, 65, 430/66, 67, 60, 84, 95

[56] References Cited

U.S. PATENT DOCUMENTS

| | | | |
|---|---|---|---|
| 4,376,688 | 3/1983 | Ceasar et al. | 204/192 |
| 4,394,425 | 7/1983 | Shimitu et al. | 430/65 |
| 4,416,755 | 11/1983 | Caesar et al. | 204/192 |
| 4,466,380 | 8/1984 | Jansen et al. | 118/712 |
| 4,513,022 | 4/1985 | Jansen et al. | 427/39 |
| 4,598,032 | 7/1986 | Saitoh et al. | 430/58 |
| 4,683,184 | 7/1987 | Osawa et al. | 430/60 X |
| 4,683,185 | 7/1987 | Osawa et al. | 430/57 |
| 4,686,164 | 8/1987 | Osawa et al. | 430/63 |

FOREIGN PATENT DOCUMENTS

| | | | |
|---|---|---|---|
| 194329 | 3/1987 | European Pat. Off. . | |
| 3525908 | 1/1986 | Fed. Rep. of Germany | 430/57 |
| 59-28161 | 3/1979 | Japan . | |
| 51-46130 | 12/1979 | Japan . | |
| 59-38753 | 6/1981 | Japan . | |
| 55-86169 | 4/1983 | Japan . | |
| 56-60447 | 9/1984 | Japan . | |
| 60-125846 | 7/1985 | Japan | 430/57 |
| 60-130747 | 7/1985 | Japan | 430/57 |
| 61-243460 | 10/1986 | Japan | 430/57 |
| 2145530A | 3/1985 | United Kingdom . | |

OTHER PUBLICATIONS

"A C-NMR Investigation of Plasma Polymerized Ethane, Ethylene, and Acetylene", by A. Dilks, S. Kaplan, and A. Vanlaeken, Xerox Webster Research Center, Xerox Square, W-114, Rochester, New York 14644.

*Primary Examiner*—Roland E. Martin

*Attorney, Agent, or Firm*—Burns, Doane, Swecker & Mathis

[57] ABSTRACT

This invention discloses a photosensitive member which comprises in the order an electrically conductive substrate, a first layer region of amorphous silicon including carbon, a second layer region of amorphous silicon and a third layer region of amorphous silicon including germanium. Group IIIA impurity of the Periodic Table is included in all the layer region so as to be most enriched at the first layer region. The first layer region comprises a first amorphous silicon transient layer to assure the adhesion between the first and second layer region. Similarly, the third layer region comprises a second amorphous silicon transient layer to assure the adhesion between the second and third layer region.

This invention further relates to a process for producing by glow discharge a photosensitive member of the present invention.

2 Claims, 3 Drawing Sheets

PHOTOSENSITIVE MEMBER HAVING AMORPHOUS SILICON-GERMANIUM LAYER AND PROCESS FOR PRODUCING SAME

BACKGROUND OF THE INVENTION

1. Field of the Invention

The present invention relates to a photosensitive member having a plurality of amorphous silicon layers and a process for producing the same, and more particularly to a photosensitive member comprising three regions and having an amorphous silicon-germanium layer in the uppermost region and also to a process for producing the same.

2. Description of the Related Art

In recent years, many attempts have been made to use amorphous silicon (hereinafter referred to as "a-Si"), amorphous germanium or amorphous silicon-germanium (hereinafter referred to as "a-Si:Ge") for electrophotographic photosensitive members, and remarkable progress has been made in the application of such material.

As compared with a-Si, a-Si:Ge in particular is smaller in optical band gap, therefore absorbs light of long wavelengths more effectively and consequently permits generation of more carriers to exhibit an improved sensitivity to light of long wavelengths. a-Si:Ge is accordingly a promising material for use in photosensitive members for printers to which semiconductor lasers are applied. Since the material has a good sensitivity at short wavelengths, it is also applicable to PPC when the spectrum of light of the exposure lamp is adjusted. Although conventional a-Si photosensitive members often produce disturbed images due to the interference of light, the material further has the excellent feature of being less prone to this drawback because the a-Si:Ge layer satisfactorily absorbs light of long wavelengths.

Unexamined Japanese Patent Publication SHO 57-115552, for example, discloses a photosensitive member which comprises an a-Si layer on a substrate, a thin a-Si:Ge layer over the layer and a thin a-Si layer over the a-Si:Ge layer. However, this photosensitive member has difficulty in preventing injection of charges from the substrate and is not chargeable to the desired surface potential. Additionally, the carriers are not easily transportable to result in an insufficient sensitivity. U.S. Pat. No. 4,451,546 proposes a photosensitive member which comprises an a-Si semiconductor layer, an a-Si:Ge photoconductive layer and an a-Si photoconductive layer formed on an electrically conductive substrate one over another. With this member, it is necessary to enable the carriers to move efficiently toward the substrate because of the presence of the a-Si:Ge photoconductive layer in the vicinity of the outermost surface, whereas there is the problem that the carriers will be trapped by the a-Si semiconductor layer in the course of their movement.

On the other hand, it is already known to employ a glow discharge decomposition apparatus for producing photosensitive members with use of a-Si, amorphous germanium (a-Ge) or a-Si:Ge. For example, the above-mentioned U.S. patent discloses a process comprising forming the a-Si semiconductor layer on the substrate by glow discharge, then interrupting the discharge and thereafter forming the a-Si:Ge layer by resuming glow discharge and supplying the required material gases. In this case, however, the a-Si semiconductor layer differs from the a-Si:Ge layer in growth mechanism and composition, so that if the a-Si:Ge layer is formed over the a-Si semiconductor layer, separation occurs at the interface. Separation similarly occurs when the a-Si layer contains a relatively large amount of another element, e.g. carbon, and the a-Si layer to be formed thereon is free from carbon.

SUMMARY OF THE INVENTION

The main object of the present invention is to provide a photosensitive member having a high sensitivity and excellent in carrier transportability and chargeability.

Another object of the present invention is to provide a photosensitive member highly sensitive to light of long wavelengths.

Another object of the present invention is to provide a photosensitive member usable for laser beam printers wherein light of long wavelengths is used for the light source.

Another object of the present invention is to provide a process for producing a photosensitive member having high durability and free of defacement or separation even when used repeatedly.

DETAILED DESCRIPTION OF THE INVENTION

Figure 1:
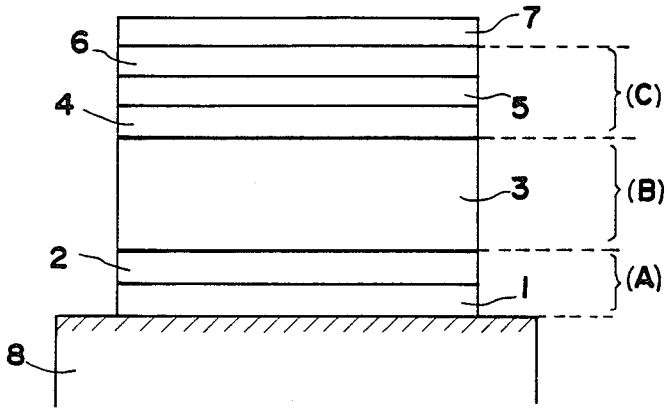
FIG. 1 is a diagram in section showing the structure of a photosensitive member of the invention.

The present invention relates to a photosensitive member which comprises, as seen in FIG. 1, a first layer region A including an undercoat layer made of carbon-containing a-Si (hereinafter referred to as "a-Si:C") as its base material, a second layer region B made of a-Si as its base material, and a third layer region C including a layer made of germanium-containing a-Si (a-Si:Ge). The three regions are formed on an electrically conductive substrate 8 as superposed on one another in the order mentioned. The first layer region A serves the function of a charge injection preventing layer, the second layer region B of a carrier transport layer, and the third layer region C of a carrier generation layer as well as of a carrier transport layer.

The photosensitive member of the present invention will be described in greater detail. The first layer region A comprises a first layer 1 made basically of a-Si:C and a second layer 2 made basically of a-Si. The second layer region B comprises a third layer 3 made basically of a-Si. The third layer region C comprises a fourth layer 4 made basically of a-Si, a fifth layer 5 made basically of a-Si:Ge and a sixth layer 6 made basically of a-Si. A seventh layer 7 made basically of a-Si:C may be formed as an overcoat layer over the third layer region C. To assure good adhesion between the layer regions, a continuous layer having no distinct junction is formed in each layer region. More specifically, to assure enhanced adhesion between the first layer region A and the second layer region B, no distinct junction is formed between the first layer 1 and the second layer 2 within the first layer region A. Thus, the second layer 2 is formed continuously with the first layer 1. The layer thus continuously formed without any distinct junction to assure high adhesion between the layer regions will hereinafter be referred to as a "transient layer ". Such a transient layer can be formed by changing the gas composition while continuing application of power from a high-frequency power source during film formation as will be described later.

A distinct junction is formed between the layer regions of the photosensitive member of the present invention to assure transport of carriers and to effectively prevent injection of charges from the substrate or the surface. This junction need not always be a P/N junction but can be a junction in a broad sense, such as P/I, $P^+/P$, $P^{++}/P^+$, I/N, $N/N^{30}$ or $N^{30}/N^{++}$ junction, which is provided by adjoining layers which are different in carrier transportability. Such a junction between the regions can be formed by interrupting application of power from the high-frequency power source during film formation and changing the film forming conditions.

Except for the seventh layer, each layer of the present photosensitive member is adjusted in polarity with an element from Group IIIA, e.g. B. The Group IIIA element is incorporated into the layer to prevent injection of charges from the substrate or surface, afford increased chargeability and provide improved carrier transportability. The content of the element increases from region to region toward the substrate.

With reference to FIG. 1, the photosensitive member of the present invention will be described in greater detail in respect of the structure of each layer region.

The first layer region A is composed of the first and second layers The first layer region A, which serves primarily as an undercoat, affords improved adhesion and bond strength between the conductive substrate and the second layer region and prevents injection of charges from the substrate to inhibit substrate noises.

The first layer 1 is made chiefly of a-Si:C and further contains boron and hydrogen The C content is suitably 5 to 60 atomic % (hereinafter abbreviated as "atm. %"), more suitably 40 to 55 atm. %. The B content is suitably 100 to 1500 ppm, more suitably 150 to 300 ppm. If the C content exceeds 60 atm. %, the residual potential exerts an unnegligible influence, whereas the C content, if less than 5 atm. %, fails to effectively prevent injection of charges from the substrate to permit occurrence of substrate noises, further resulting in impaired adhesion to the substrate with the likelihood that the photosensitive layer will entirely separate off.

B is used to make the first layer the P type, thereby preventing injection of charges from the substrate and also to afford improved carrier transportability. The B content, if less than 100 ppm, fails to produce these effects, readily permitting occurrence of substrate noises When the B content exceeds 1500 ppm, the impurity level is excessively high, resulting in too high an electrical conductivity and no longer achieving a charge injection preventing effect.

The thickness of the first layer is suitably 0.005 to 1.0 μm, more suitably 0.2 to 0.4 μm. If the thickness is larger, the influence of the residual potential appears, whereas smaller thicknesses fail to achieve a sufficient effect to prevent injection of charges and result in lower adhesion.

The first layer contains a relatively large amount of C, so that if the third layer made of a-Si free from any C or containing a trace of C is formed directly on the first layer, the adhesion between the first and third layers reduces. Accordingly, the second layer 2 containing no C or a trace of C like the third layer is formed on the first layer. The second layer 2 is made of a-Si and further contains boron and hydrogen This layer is a so-called transient layer and is provided to assure intimate adhesion between the first layer region A and the second layer region B to be described below. Since the transient layer, i.e. the second layer 2, is formed continuously with the first layer 1, no distinct junction is formed between the first layer 1 and the second layer 2. The second layer 2, which contains B and is therefore of the P type, prevents injection of charges from the substrate. The B content is suitably 100 to 1500 ppm, more suitably 150 to 300 ppm, for the same reason as in the case of the first layer The second layer has a thickness of 0.01 to 1.0 μm, preferably 0.03 to 0.4 μm, such that the combined thickness of the first and second layers will be 0.015 to 1.5 μm.

When the thickness of the second layer 2 exceeds 1.0 μm, the movement of a small number of carriers (electrons) to be produced upon exposure to light of long wavelengths is completely impeded, appreciably exerting an adverse effect on the sensitivity to long wavelengths If the thickness is below the lower limit, impaired adhesion results between the first layer region and the second layer region, leading to separation of the second and higher layer regions.

The second layer region B comprises the third layer 3 formed of a-Si and containing oxygen, boron and hydrogen and acts as a carrier transport layer. The region B gives a substantial thickness and pressure resistance to the overall photosensitive layer.

The third layer 3 has an O content of $10^{-5}$ to 0.3 atm. %, preferably 0.05 to 0.25 atm. %, and a B content of 5 to 100 ppm, preferably 10 to 30 ppm, which is greater than the B content of the fourth layer to be described later. The third layer is preferably 5 to 100 μm, more preferably 20 to 40 μm, in thickness.

When the thickness is below the lower limit, the electrophotographic process encounters difficulty in charging the photosensitive member to the desired surface potential to result in a lower image density.

If the thickness exceeds the upper limit, the surface potential will reach saturation, or the a-Si film, which inherently forms at a low rate, requires a longer deposition time and is inefficient to produce without any advantage in respect of the characteristics.

When the oxygen content is below the lower limit, sufficient chargeability is not available.

The oxygen content, if exceeding the upper limit, results in higher resistance, inefficient carrier transport, lower sensitivity and a higher surface potential In place of or in addition to oxygen, a trace (up to 1 atm. %) of carbon may be incorporated into the third layer.

The third layer 3 must be of a larger thickness than the other layers and is therefore to be formed at a higher rate (3 μm/h to 15 μm/h), for example, by increasing the quantities of gases or the amount of power. Accordingly, the third layer (i.e. the second layer region) is to be formed under conditions greatly different from those for forming the other layer regions.

For this reason, the second layer having substantially the same structure as the second layer region is provided between the second and first layer regions as already stated. Furthermore, the fourth layer substantially identical with the second layer region in structure is provided between the second and third layer regions. More specifically stated, if the fifth layer of a-Si:Ge to be described later is formed directly on the third layer providing the second layer region, separation occurs at the interface owing to differences in constituent elements, component ratio and film forming conditions. To assure intimate adhesion at the interface, therefore, the fourth layer of substantially the same structure as the third layer is provided. Thus, the fourth layer also serves the function of a transient layer like the second layer. The fourth layer will be described later in detail.

When the third layer is smaller than the fourth layer in B content, a junction acting as a kind of barrier against the carriers is formed between the third and fourth layers to entail a reduced sensitivity, image disturbance, residual potential, etc.

If the B content exceeds the upper limit, the bulk of the layer has an elevated impurity level, which permits generation of an increased number of thermally excited carriers, leading to insufficient charge retentivity.

The third region C is formed on the second layer region B. The third layer region C comprises three layers which are fourth to sixth from the substrate side.

The third layer region is associated with the generation and movement of carriers and is suitably 0.35 to 10.5 μm, more suitably 1.5 to 5 μm, in overall thickness.

Like the third layer, the fourth layer 4 is made of a-Si and contains oxygen, boron and hydrogen. The fourth layer 4 is a transient layer serving the function of assuring chargeability, extraction of carriers (holes) from the fifth layer and adhesion of the fourth layer to the third layer. The fourth layer may contain a trace (up to 1 atm. %) of carbon in place of, or in addition to, oxygen. The O content is $10^{-5}$ to 0.3 atm. %, preferably 0.05 to 0.25 atm. %. The B content is up to 30 ppm and is greater than in the fifth layer. The thickness of the fourth layer is suitably 0.1 to 3.0 μm, more suitably 0.5 to 2 μm.

When the thickness exceeds the upper limit, it becomes difficult for the carriers extracted from the fifth layer to efficiently advance into the third layer serving as a transport layer to result in a lower sensitivity.

When the thickness is below the lower limit, impaired adhesion results between the second layer region and the third layer region, leading to the separation of the overall third layer region.

The oxygen content, when exceeding the upper limit, results in higher resistance and a rise in the residual potential. Further the increased amount of oxygen provides a barrier against the carriers, permitting transverse flow of carriers to produce disturbed images. If the barrier effect is low, the carriers exhibit reduced mobility to entail a reduced sensitivity.

Oxygen contents below the lower limit lead to an insufficient dark resistivity and lower chargeability.

When the B content is above the upper limit, the layer becomes excessively P-type and encounters difficulty in forming a junction with the third layer. That is to say, unless the third layer is stronger than the fourth layer in P-type properties, the junction of bands relative to the carriers becomes opposite, giving rise to the necessity of increasing the B content of tee third layer and consequently generating an increased number of thermally excited carriers to result in impaired chargeability. The upper limit of B content is set for the fourth layer to obviate such a need to increase the B content of the third layer.

If the B content is lower in the fourth layer than in the fifth layer, a junction will be formed between these two layers to act as a barrier against the carriers (holes) generated in the fifth and sixth layers, entailing a lower sensitivity or causing transverse flow of carriers to produce disturbed images.

The fourth layer is a transient layer as already mentioned and is formed to preclude the possible separation between the second layer region and the third layer region. If the fifth layer is formed directly on the third layer, the difference between the third and fifth layers in properties reduces the adhesion between these two layers. The fourth layer, which is almost identical with the third layer in structure, is therefore provided to assure good adhesion between the second and third layer regions.

The fifth layer 5 is made of a-Si and contains germanium, oxygen, boron and hydrogen. The presence of Ge ensures satisfactory long-wavelength sensitivity and chargeability. Whereas interference fringes often occur when a-Si photosensitive members are exposed to a coherent beam of long wavelength which is typical of the beams emitted by semiconductor lasers, for example, when such a member is used in a laser printer, the provision of the fifth layer serves to diminish this objection. Furthermore, the long-wavelength sensitivity is adjustable by varying the thickness of this layer.

The fifth layer 5 contains Ge in an amount of 5 to 50 atm. %, preferably 20 to 30 atm. %, O in an amount of $10^{-5}$ to 0.3 atm. %, preferably 0.05 to 0.25 atm. %, and B in an amount of up to 15 ppm which is preferably the same as or not smaller than the B content of the sixth layer. The thickness of the fifth layer is suitably 0.1 to 3.0 μm, more suitably 1.0 to 2.5 μm.

The Ge content, when exceeding the upper limit, reduces the mobility of carriers (as characteristic of Ge doping), failing to afford a suitable sensitivity.

If the Ge content is below the lower limit, light of long wavelengths will not be fully absorbed. This reduces the amount of carriers to be generated and leads to an impaired sensitivity.

Oxygen contents beyond the upper limit produce higher resistance and a higher residual potential, further producing wider band gaps to impair the desired function of the layer although the Ge-doped film is inherently small in band gap and has a good sensitivity to long-wavelength light.

If the oxygen content is below the lower limit, a sufficient dark resistivity will not be obtained to result in lower chargeability.

If the B content is above the upper limit, the layer exhibits excessively strong P-type properties, with the result that the injection of holes from the surface can not be prevented by the sixth and seventh layers alone when the member is positively charged, hence lower chargeability.

When the B content is lower in the fifth layer than in the sixth layer, the junction between the fifth and sixth layer acts as a barrier against the electrons excited by light of long wavelengths within the fifth layer and against the holes excited by light of short wavelengths within the sixth layer, impeding the movement of carriers to result in an impaired sensitivity and further producing disturbed images due to transverse flow of carriers.

If the thickness is larger than the upper limit, the carriers are unable to pass through the Ge-doped layer, ceasing to act as such owing to reunion or the like and consequently failing to contribute to the sensitivity, since the mobility of carriers in this layer is low.

If the thickness is smaller than the lower limit, the layer is unable to fully absorb light and to assure a satisfactory sensitivity.

The sixth layer 6 is made of a-Si, contains oxygen, boron and hydrogen and is provided to assure short-wavelength sensitivity and chargeability. It is suitable that this layer be 0.1 to 3.0 μm, more suitably 1.0 to 2.5 μm, in thickness. The oxygen content is $10^{-5}$ to 0.3 atm. %, preferably 0.05 to 0.25 atm. %. The B content is up to 15 ppm and is equal to or lower than that of the fifth layer.

When the thickness is beyond the upper limit, the layer absorbs an increased amount of light to decrease the amount of light reaching the fifth layer which has a high sensitivity to light of long wavelengths, failing to assure sensitivity.

Thicknesses less than the lower limit fail to assure sufficient absorption of light and therefore sensitivity to visible light.

The oxygen content, when exceeding the upper limit, results in higher resistance and a higher residual potential, further producing wider band gaps to entail a lower sensitivity to visible light.

If the oxygen content is below the lower limit, an insufficient dark resistivity will result to entail lower chargeability.

The B content, if exceeding the upper limit, affords excessively strong P-type properties, with the result that the injection of holes from the surface upon positive charging can not be prevented by the seventh layer only to result in impaired chargeability.

The fifth layer and the sixth layer may contain a trace (up to 1 atm. %) of carbon in place of, or in addition to, oxygen.

According to the present invention, it is desirable that the seventh layer 7 be provided as an overcoat layer over the third layer region C.

The seventh layer 7 is made of a-Si:C, contains hydrogen and is provided for protecting the surface especially against moisture and abrasion. To permit a sufficient quantity of light to penetrate into the underlying layers, the seventh layer incorporates C and is thereby given an improved light transmitting property. The C content is suitably 50 to 80 atm. %, more suitably 65 to 75 atm. %. The thickness of the seventh layer is preferably 0.05 to 1.5 μm, more preferably 0.1 to 0.5 μm.

When the C content, as well as the thickness, exceeds the upper limit, excessively high resistance will result to entail a higher residual potential or the drawback that the carriers moving from the underlying layer can not pass through the seventh layer but flow transversely to produce disturbed images.

If the C content, as well as the thickness, is below the lower limit, the surface has reduced hardness and becomes more susceptible to damage.

The C content, if lower than the lower limit, fails to provide resistance to moisture and abrasion and is liable to permit disturbance of images at a high humidity and mechanical damage. Furthermore, an impaired light transmitting property and reduced sensitivity will result.

The electrically conductive substrate to be used for the photosensitive member of the present invention may be rough-surfaced to preclude occurrence of the above-mentioned interference fringes or may be suitably surface-treated, for example, by electropolishing, alkali etching or anodic oxidation to prevent injection of charges.

As will be apparent from the foregoing description, the photosensitive member of the present invention comprises first, second and third layer regions formed on a substrate one over another. The B content is highest in the first layer region, lower in the second region than in the first and still lower in the third region than in the second. This assures the carriers of high transportability and effectively prevents injection of charges from the substrate when the member is charged positively.

The photosensitive member of the present invention can be used for apparatus wherein visible light is used as an image exposure light source and also for those wherein a semiconductor laser is used at a wavelength of at least 700 nm.

The photosensitive member of the present invention is produced by the process to be described below with reference to FIG. 2.

Figure 2:
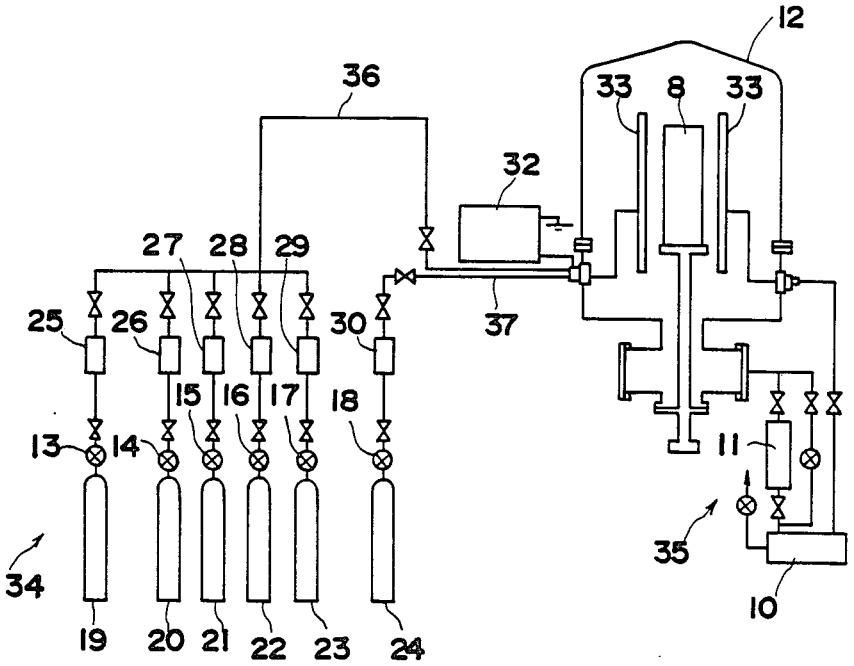
FIG. 2 is a diagram showing an apparatus for producing photosensitive members of the invention.

FIG. 2 shows a glow discharge decomposition apparatus for practicing the process of the present invention. The apparatus comprises a reaction chamber 12, a material gas supply system 34 and a gas discharge system 35. The reaction chamber 12 has electrode plates 33 and is connected to the gas supply system 34 and the discharge system 35. After the reaction chamber 12 has been evacuated to a high vacuum by the discharge system 35, material gases are fed to the chamber 12 by the supply system 34. The electrode plates 33 are connected to a high-frequency power source 32 to subject the material gases fed to the chamber 12 to glow discharge decomposition.

An electrically conductive substrate 8 is in the form of a hollow cylinder made of a conductive material such as aluminum, stainless steel or Nesa Glass. An a-Si photosensitive layer or like film is to be formed over the outer peripheral surface of the substrate 8 by capacitive coupling glow discharge decomposition.

The material gas supply system 34, for example, for forming an a-Si photosensitive layer has first to sixth tanks 19 to 24 containing $H_2$, $SiH_4$, $B_2H_6$, $GeH_4$, $C_2H_4$ and $O_2$ gases, respectively. The first to fifth tanks 19 to 23 are connected to a first main pipe 36 via first to fifth control valves 13 to 17 and mass flow controllers 25 to 29, respectively. The sixth tank 24 is connected to a second main pipe 37 via a sixth control valve 18 and a mass flow controller 30. The material gas contained in each tank is fed to the reaction chamber 12 through the first main pipe 36 or the second main pipe 37.

The discharge system 35 for evacuating the interior of the reaction chamber 12 to a vacuum and maintaining the chamber at a specified internal pressure comprises a rotary pump 10 and diffusion pump 11.

The photosensitive member shown in FIG. 1 and embodying the present invention is produced by the following process using the glow discharge decomposition apparatus of the above construction.

First, the reaction chamber 12 is evacuated by the discharge system 35 to a vacuum of about $10^{-5}$ to about $10^{-6}$ torr, and the conductive substrate 8 is preheated to 200° to 300° C. The first to third and fifth control valves 13, 14, 15 and 17 are then opened to supply $H_2$ gas from the first tank 19, $SiH_4$ gas from the second tank 20, $B_2H_6$ gas from the third tank 21 and $C_2H_4$ from the fifth tank 23 at a suitable flow rate ratio. These gases have their flow rates controlled by the mass flow controllers 25, 26, 27 and 29 and are fed to the reaction chamber 12 via the first main pipe 36.

On the other hand, the high-frequency power source 32 applies a high-frequency voltage of 13.56 MHz to the substrate 8 for supplying power of 150 to 300 watts while the substrate 8 is being drivingly rotated by an unillustrated drive source. Accordingly, glow discharge occurs between the substrate 8 and the electrodes 33 to form on the substrate 8 an a-Si layer (first layer) containing hydrogen, boron and carbon.

After the first layer has been formed, the control valve 17 is closed to pass no $C_2H_4$ gas or is gradually closed to decrease $C_2H_4$ gas through the mass flow controller 29 without discontinuing the power application by the power source 32. With the other conditions maintained as in the step of forming the first layer, an a-Si:B:H layer (second layer) containing hydrogen and boron or further a trace of carbon is formed. As already described, the second layer 2 is a transient layer for assuring good adhesion between the first layer region A of the present photosensitive member and the second layer region B thereof. The layer 2 has substantially the same structure as the third layer to be described later. Since the transient layer, i.e., the second layer is formed without interrupting the power application by the power source 32, the second layer 2 is formed continuously with the first layer 1. Consequently, no distinct junction is formed between the first layer 1 and the second layer 2.

After the second layer has been formed, the application of power from the power source 32 is discontinued, the mass flow controllers 25, 26 and 27 are set to zero flow rate, and the reaction chamber is throughly evacuated. Subsequently, the supply system 34 feeds to the reaction chamber 12 $H_2$ gas from the first tank 19, $SiH_4$ gas from the second tank 20, $B_2H_6$ gas from the third tank 21 and $O_2$ gas from the sixth tank 24 in a suitable flow rate ratio. In this case, $C_2H_4$ gas may further be supplied from the fifth tank (23) in a trace flow rate ratio.

In this state, the power source 32 then applies a high-frequency voltage to the substrate. This causes glow discharge across the substrate 8 and the electrodes 33, forming an a-Si layer (third layer) containing oxygen, boron and hydrogen or further a trace of carbon.

After the third layer has been formed, the power application by the power source 32 is discontinued, the mass flow controllers 13, 14, 15 and 18 are set to zero flow rate, and the reaction chamber 12 is thoroughly degassed. Subsequently, the supply system 34 feeds to the reaction chamber 12 $H_2$ gas from the first tank 19, $SiH_4$ gas from the second tank 20, $B_2H_6$ gas from the third tank 21 and $O_2$ gas from the sixth tank 24 in a suitable flow rate ratio. In this case, $C_2H_4$ gas may further be supplied from the fifth tank (23) in a trace flow rate ratio. The power source 32 applies a high-frequency voltage to cause glow discharge between the substrate 8 and the electrodes 33. Consequently, an a-Si layer (fourth layer) containing hydrogen, boron and oxygen or further a trace of carbon is formed over the third layer. Like the foregoing second layer, the fourth layer serves the function of a transient layer. More specifically, if the fifth layer of a-Si:Ge:O:B:H to be stated later is formed on the third layer, separation occurs at the interface since the third layer and fifth layer differ in film forming conditions, constituent elements and component ratio. To obviate the separation, the fourth layer having substantially the same structure as the third layer is provided between the third layer and the fifth layer. This assures good adhesion between the second layer region B comprising the third layer and the third layer region C to be formed thereon.

After the fourth layer has been formed, fifth to seventh layers are formed changing the gas composition only by adjusting the mass flow controllers, without discontinuing the power supply by the power source 32 and also without evacuating the reaction chamber 12. Stated more specifically, the gas supply system 34 admits to the reaction chamber 12 $H_2$ gas from the first tank 19, $SiH_4$ gas from the second tank 20, $B_2H_6$ gas from the third tank 21, $GeH_4$ gas from the fourth tank 22 and $O_2$ gas from the sixth tank 24 to form the fifth layer; $H_2$ gas from the first tank 19, $SiH_4$ gas from the second tank 20, $B_2H_6$ gas from the third tank 21 and $O_2$ gas from the sixth tank 24 to form the sixth layer; and $H_2$ gas from the first tank 19, $SiH_4$ gas from the second tank 20 and $C_2H_4$ gas from the fifth tank 23 to form the seventh layer. Consequently formed over the fourth layer are the fifth layer of a-Si:Ge:0:B:H, the sixth layer of a-Si:O:B:H and the seventh layer of a-Si:C:H.

The photosensitive member thus prepared has an excellent long-wavelength sensitivity and high image stability and is satisfactorily usable in respect of any characteristic. The transient layer provided between the layer regions precludes separation therebetween.

Example 1 (preparation of photosensitive member Al)

Step (1):

In the glow discharge decomposition apparatus of FIG. 2, the rotary pump 10 was operated first, and the diffusion pump 11 was then operated to evacuate the reaction chamber 12 to a high vacuum of about $10^{-6}$ torr. The first to third and fifth control valves 13, 14, 15 and 17 were thereafter opened to introduce into the mass flow controllers 25, 26, 27 and 29 $H_2$ gas from the first tank 19, 100% $SiH_4$ gas from the second tank 20, $B_2H_6$ gas as diluted to 200 ppm with $H_2$ from the third tank 21 and $C_2H_4$ gas from the fifth tank 23, at an output gauge pressure of 1 kg/cm$^2$ The gases were admitted into the reaction chamber 12 with these mass flow controllers adjusted to the flow rates of 300 sccm for $H_2$, 100 sccm for $B_2H_6$ (calculated as 200 ppm/$H_2$) and 120 sccm for $C_2H_4$. After the gas flows stabilized, the reaction chamber 12 was adjusted to an internal pressure of 1.0 torr. On the other hand, an electrically conductive substrate 8 in the form of an aluminum drum with a diameter of 80 mm was preheated to 250° C. After the gas flows stabilized with the internal pressure at a stable level, the high-frequency power source 32 was turned on to apply power (13.56 MHz in frequency) of 200 watts across the electrode plates 33 to cause glow discharge. The glow discharge was continued for 3.5 minutes to form on the substrate 8 a first layer 1 having a thickness of about 0.35 μm and containing hydrogen and boron.

Step (2):

After the formation of the first layer 1, the rate of $C_2H_4$ flow through the mass flow controller 29 was reduced to zero within 30 seconds after closing the control valve 17 without discontinuing the application of power by the power source. With the exception of this procedure, the same conditions as in step (1) were maintained to form a second layer 2 having a thickness of 0.05 μm.

Step (3):

After the formation of the second layer 2, the power application by the power source 32 was discontinued, the mass flow controllers were set to zero flow rate, and the reaction chamber 12 was fully evacuated. The supply system 34 was then operated to introduce into the reaction chamber 12 $H_2$ gas from the first tank 19 at 400 sccm, 100% $SiH_4$ from the second tank 20 at 200 sccm, $B_2H_6$ gas as diluted to 200 ppm with $H_2$ from the third tank 21 at 20 sccm and $O_2$ gas from the sixth tank 24 at 2 sccm. The reaction chamber was adjusted to an internal pressure of 1.0 torr, and the power source was turned on for the application of power of 300 watts. The discharge was continued for about 4 hours to form a third layer 3 about 28 μm in thickness.

Step (4):

After the completion of step (3), the power application by the power source was discontinued, the mass flow controllers were set to zero flow rate, and the reaction chamber was fully evacuated. A fourth layer 4 having a thickness of 1.2 μm was then formed at the flow rates and under the conditions given below.

| Gas | Tank | Flow rate (sccm) | Applied power (W) | Pressure (torr) |
|---|---|---|---|---|
| $SiH_4$ | 20 | 100 | | |
| $B_2H_6$ (200 ppm/$H_2$) | 21 | 8 | | |
| $GeH_4$ | 22 | 0 | 200 | 1.0 |
| $C_2H_4$ | 23 | 0 | | |
| $O_2$ | 24 | 1 | | |
| $H_2$ | 19 | 400 | | |

Step (5):

After the completion of step (4), fifth to seventh layers 5 to 7 were formed adjusting the mass flow controllers to change the gas composition only within 30 seconds as listed in Table 1, without interrupting the power application and also without evacuating the reaction chamber The film forming conditions are as follows.

TABLE 1

| Layer | $SiH_4$ sccm | $B_2H_6$ sccm | $GeH_4$ sccm | $C_2H_4$ sccm | $O_2$ sccm | $H_2$ sccm | Power W | Pressure torr | Thickness μm |
|---|---|---|---|---|---|---|---|---|---|
| 7th | 50 | 0 | 0 | 150 | 0 | 400 | 200 | 1.0 | 0.3 |
| 6th | 100 | 5 | 0 | 0 | 1 | 400 | 200 | 1.0 | 2.0 |
| 5th | 80 | 5 | 20 | 0 | 1 | 400 | 200 | 1.0 | 2.0 |

$GeH_4$ was supplied from the tank 22 via the control valve 16 and the mass flow controller 28.

Table 2 shows the composition of the photosensitive member Al thus prepared.

TABLE 2

| | | |
|---|---|---|
| 7th Layer | C/(Si + C) = 0.68 | B/(Si + Ge) = 0 at. ppm |
| 6th Layer | O/(Si + O) = 0.0008 | B/(Si + Ge) = 10 at. ppm |
| | O/(Si + Ge + O) = 0.0008 | B/(Si + Ge) = 13 at. ppm |
| 5th Layer | Ge/(Si + Ge + O) = 0.17 | B/(Si + Ge) = 13 at. ppm |
| 4th Layer | O/(Si + O) = 0.0008 | B/(Si + Ge) = 16 at. ppm |
| 3rd Layer | O/(Si + O) = 0.0008 | B/(Si + Ge) = 20 at. ppm |
| 2nd Layer | — | B/(Si + Ge) = 200 at. ppm |
| 1st Layer | C/(Si + C) = 0.48 | B/(Si + Ge) = 200 at. ppm |

Although $H_2$ was used as the carrier gas in the above example, other inert gas such as Ar or the like is usable. The Si source may be $Si_2H_4$ or like gas. The C source may be $C_3H_8$, $CH_4$, $C_2H_6$ or the like. The O source may be $N_2O$, NO or the like. The electrode assembly, which was of the capacitive coupling type as seen in FIG. 2, may alternatively be of the induction coupling type.

Example 2

Photosensitive members B1, C1 and D1 were prepared in the same manner as in Example 1 except that the fifth layer was formed with the following thickness.

| Photosensitive member | Thickness of 5th layer (μm) |
|---|---|
| B1 | 0.2 |
| C1 | 1.0 |
| D1 | 3.0 |

Example 3

Photosensitive members E1, F1 and G1 were prepared in the same manner as in Example 1 except that the flow rate of GeH4 was altered to vary the Ge content of the fifth layer as shown below.

| Photosensitive member | $GeH_4$ flow rate (sccm) | Ge content (atm. %) (Ge/(Si + Ge + O)) |
|---|---|---|
| E1 | 5 | 0.05 |
| F1 | 10 | 0.11 |
| G1 | 30 | 0.23 |

Comparative Example 1

A photosensitive member H1 was obtained in the same manner as in Example 1 except that the fifth layer was not provided.

Example 4

Figure 3:
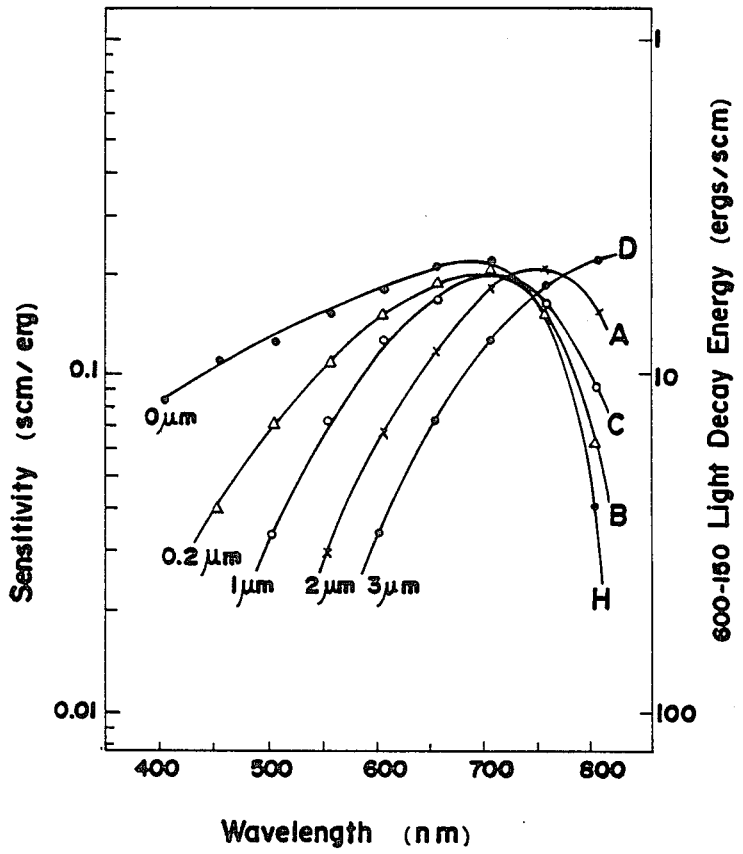
FIGS. 3 and 4 are diagrams showing the long wavelength sensitivity of photosensitive members.

The photosensitive members A1, B1, C1, D1 and H1 obtained in Examples 1 and 2 and Comparative Example 1 were charged to 600 V by a corona charger, and the energy required for the potential to undergo a light decay to 150 V was measured to thereby determine the spectral sensitivity. FIG. 3 shows the results. In the diagram, curves A1 to H1 represent the results achieved by the members A1 to H1, respectively. The wavelength (nm) is plotted as abscissa vs. the sensitivity (scm/erg) as ordinate.

Example 5

Figure 4:
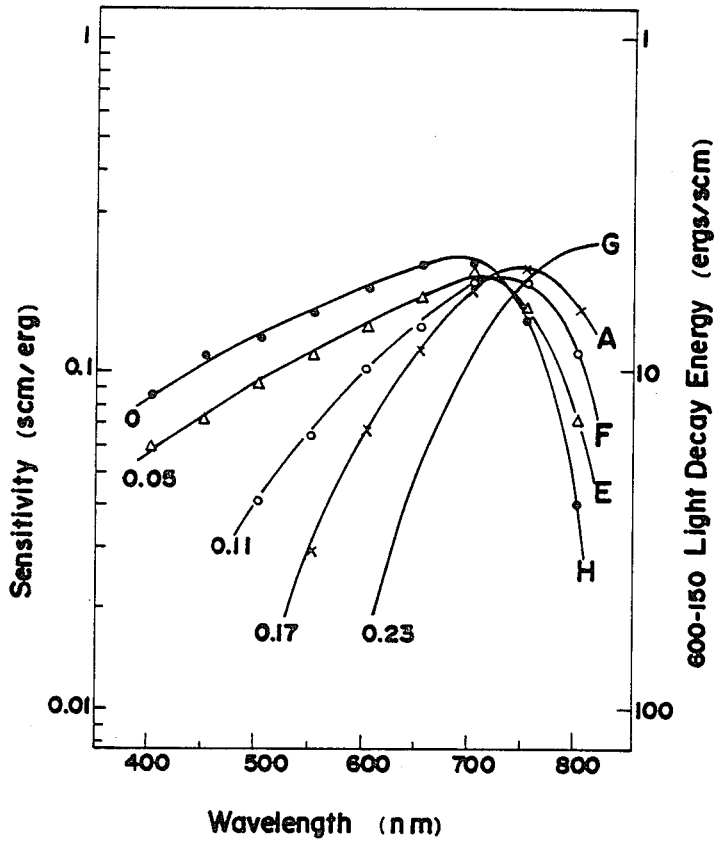

The spectral sensitivity of the photosensitive members A1, E1, F1, G1 and H1 was measured in the same manner as in Example 4. FIG. 4 shows the results which are indicated by the corresponding symbols A1, E1, F1, G1 and H1.

Example 6

Photosensitive members A2, B2, C2, D2, E2, F2 and G2 were prepared in the same manner as the photosensitive members A1, B1, C1, D1, E1, F1 and G1, respectively, which were obtained in Examples 1 to 3 with the exception of interrupting the application of power by the power source 32 after forming the first layer and subsequently forming the third to seventh layers without providing the second layer.

A fragmentary drum piece was cut off from each of the members A2 to G2 obtained, and the section thereof was polished with sandpaper (#8000) and then observed under an electron microscope (Model JSM-T300, product of JEOL, Ltd.). Consequently, it was found that a portion had been left adhered to the substrate after separation. Three pieces of such a portion were collected from each of the photosensitive members A2 to G2. Table 3 shows the thickness of these pieces measured.

Table 3 reveals that the third and overlying layers separated from the above-mentioned portion.

TABLE 3

| Sample | Measurement (μm) | | | Average (μm) |
|---|---|---|---|---|
| A2 | 0.34 | 0.34 | 0.35 | 0.34 |
| B2 | 0.36 | 0.35 | 0.35 | 0.35 |
| C2 | 0.35 | 0.34 | 0.35 | 0.35 |
| D2 | 0.34 | 0.35 | 0.34 | 0.34 |
| E2 | 0.35 | 0.35 | 0.35 | 0.35 |
| F2 | 0.36 | 0.36 | 0.35 | 0.36 |
| G2 | 0.35 | 0.34 | 0.35 | 0.35 |

Example 7

Photosensitive members A3, B3, C3, D3, E3, F3 and G3 were prepared in the same manner as the photosensitive members A1, B1, C1, D1, E1, F1 and G1, respectively, which were obtained in Examples 1 to 3 with the exception of interrupting the application of power by the power source 32 after forming the third layer and subsequently forming the fifth and overlying layers without providing the fourth layer.

A fragmentary drum piece was cut off from each of the members A3 to G3 obtained, and the section thereof was polished with sandpaper (#8000) and then observed under the electron microscope to find that a portion had been left adhered to the substrate after separation. Three pieces of such a portion were collected from each of the members A3 to G3. Table 4 shows the thickness of these pieces measured.

Table 4 reveals that the fifth and upper layers separated from the above portion.

TABLE 4

| Sample | Measurement (μm) | | | Average (μm) |
|---|---|---|---|---|
| A3 | 28.3 | 28.3 | 28.4 | 28.3 |
| B3 | 28.4 | 28.4 | 28.3 | 28.4 |
| C3 | 28.2 | 28.2 | 28.3 | 28.2 |
| D3 | 28.3 | 28.3 | 28.4 | 28.3 |
| E3 | 28.3 | 28.4 | 28.3 | 28.3 |
| F3 | 28.4 | 28.4 | 28.3 | 28.4 |
| G3 | 28.4 | 28.4 | 28.3 | 28.4 |

Example 8

Photosensitive members A4, B4, C4, D4, E4, F4 and G4 were prepared in the same manner as the photosensitive members A1, B1, C1, E1, F1 and G1, respectively, which were obtained in Examples 1 to 3, except that the second layer region was formed directly on the substrate without providing the first layer. Five samples of each kind of the members A4 to G4 were prepared using substrates made of a particular aluminum alloy and having a particular surface roughness. The samples were checked for separation between the layer regions, and the chargeability of the coated portion was measured (charging condition: 0.28 $\mu c/cm^2$).

Also prepared were five samples of each kind of the photosensitive members A1, B1, C1, D1, E1, F1 and G1, similarly using substrates made of a particular aluminum alloy and having a specified surface roughness. The samples were checked for separation between the layer regions, and the chargeability of the coated portion was measured (charging condition: 0.28 $\mu c/cm^2$).

The aluminum material used for the substrates was Al-Mg-Si alloy according to JIS 6063, Al-Mg alloy, JIS 5386, or Al-Mn, JIS 3003. The substrate surface roughness was 0.02 μm or 0.3 μm.

The results are listed in Tables 5(a) to 5(c), in which the symbols mean the following: N . . . no separation. P . . . partial separation. E . . . entire separation. The numerical values listed show chargeabilities (V/μm). The chargeability was not measurable as to the samples with entire separation. For the samples with partial separation, the chargeability of the unseparated portion was measured.

Tables 5(a) to 5(c) indicate that separation occurred between the substrate and the second layer region in a majority of the samples having the second layer region formed directly on the substrate without the first layer region. It is seen that the samples having no first layer region are lower in chargeability than those having the first layer. This means that the first layer region of the present invention precludes separation and assures good chargeability.

TABLE 5 (a)

| | Al material: JIS 6063 (Al—Mg—Si) | | | | | | | | | |
|---|---|---|---|---|---|---|---|---|---|---|
| Sample | Roughness 0.02 μm | | | | | Roughness: 0.3 μm | | | | |
| A1 | N | N | N | N | N | N | N | N | N | N |
| | 22 | 23 | 22 | 22 | 23 | 23 | 22 | 22 | 22 | 23 |
| A4 | N | P | P | E | E | N | N | P | P | P |
| | 15 | 16 | 14 | | | 15 | 14 | 15 | 16 | 13 |
| B1 | N | N | N | N | N | N | N | N | N | N |
| | 24 | 23 | 23 | 23 | 24 | 23 | 24 | 24 | 23 | 23 |
| B4 | P | P | P | P | E | N | P | P | E | E |
| | 15 | 14 | 16 | 15 | | | 14 | 14 | 15 | |
| C1 | N | N | N | N | N | N | N | N | N | N |
| | 22 | 22 | 23 | 23 | 23 | 23 | 23 | 22 | 22 | 23 |
| C4 | N | P | P | E | E | P | P | P | P | E |
| | 14 | 15 | 15 | | | 14 | 14 | 15 | 14 | |
| D1 | N | N | N | N | N | N | N | N | N | N |
| | 22 | 21 | 22 | 21 | 22 | 21 | 21 | 22 | 22 | 22 |
| D4 | N | P | P | P | E | P | P | P | E | E |
| | 13 | 15 | 14 | 14 | | 14 | 13 | 14 | | |
| E1 | N | N | N | N | N | N | N | N | N | N |
| | 24 | 23 | 23 | 23 | 24 | 23 | 23 | 24 | 24 | 23 |
| E4 | P | P | P | P | P | P | P | P | P | E |
| | 15 | 14 | 14 | 15 | 13 | 14 | 15 | 15 | 14 | |
| F1 | N | N | N | N | N | N | N | N | N | N |
| | 22 | 23 | 23 | 22 | 23 | 23 | 22 | 23 | 22 | 23 |
| F4 | P | P | P | P | E | P | P | E | E | E |
| | 14 | 15 | 15 | 14 | | 14 | 14 | | | |
| G1 | N | N | N | N | N | N | N | N | N | N |
| | 21 | 22 | 22 | 21 | 22 | 22 | 21 | 22 | 22 | 21 |
| G4 | N | P | P | P | E | P | P | P | E | E |
| | 13 | 15 | 14 | 14 | | 15 | 14 | 15 | | |

TABLE 5 (b)

| | Al material JIS 5386 (Al—Mg) | | | | | | | | | |
|---|---|---|---|---|---|---|---|---|---|---|
| Sample | Roughness: 0.02 μm | | | | | Roughness: 0.3 μm | | | | |
| A1 | N | N | N | N | N | N | N | N | N | N |
| | 22 | 22 | 23 | 22 | 22 | 22 | 23 | 22 | 22 | 22 |
| A4 | P | P | E | E | E | P | P | E | E | E |
| | 8 | 9 | | | | 8 | 7 | | | |
| B1 | N | N | N | N | N | N | N | N | N | N |
| | 23 | 23 | 23 | 23 | 24 | 23 | 23 | 23 | 23 | 24 |
| B4 | P | P | E | E | E | P | P | E | E | E |
| | 8 | 7 | | | | 8 | 8 | | | |
| C1 | N | N | N | N | N | N | N | N | N | N |
| | 22 | 23 | 22 | 22 | 23 | 22 | 23 | 23 | 23 | 22 |
| C4 | P | P | E | E | E | P | P | E | E | E |
| | 6 | 7 | | | | 5 | 6 | | | |

TABLE 5 (b)-continued

| Sample | Al material JIS 5386 (Al—Mg) Roughness: 0.02 μm | | | | | Roughness: 0.3 μm | | | | |
|---|---|---|---|---|---|---|---|---|---|---|
| D1 | N | N | N | N | N | N | N | N | N | N |
| | 22 | 21 | 22 | 21 | 22 | 22 | 22 | 21 | 22 | 21 |
| D4 | P | P | E | E | E | P | P | E | E | E |
| | 5 | 6 | | | | 6 | 5 | | | |
| E1 | N | N | N | N | N | N | N | N | N | N |
| | 23 | 23 | 24 | 23 | 23 | 23 | 23 | 24 | 24 | 23 |
| E4 | P | P | E | E | E | P | P | E | E | E |
| | 5 | 4 | | | | 6 | 5 | | | |
| F1 | N | N | N | N | N | N | N | N | N | N |
| | 23 | 22 | 23 | 22 | 22 | 23 | 23 | 22 | 22 | 23 |
| F4 | P | P | E | E | E | P | P | P | E | E |
| | 4 | 6 | | | | 6 | 5 | 5 | | |
| G1 | N | N | N | N | N | N | N | N | N | N |
| | 21 | 21 | 22 | 22 | 22 | 22 | 21 | 21 | 22 | 22 |
| G4 | P | P | P | E | E | P | P | E | E | E |
| | 5 | 4 | 5 | | | 6 | 4 | | | |

TABLE 5 (c)

| Sample | Al material: JIS 3003 (Al—Mn) Roughness: 0.02 μm | | | | | Roughness: 0.3 μm | | | | |
|---|---|---|---|---|---|---|---|---|---|---|
| A1 | N | N | N | N | N | N | N | N | N | N |
| | 22 | 22 | 22 | 23 | 22 | 22 | 22 | 22 | 22 | 23 |
| A4 | P | P | P | E | E | P | P | P | E | E |
| | 10 | 8 | 11 | | | 10 | 10 | 11 | | |
| B1 | N | N | N | N | N | N | N | N | N | N |
| | 23 | 23 | 23 | 23 | 24 | 23 | 23 | 23 | 23 | 24 |
| | P | P | P | E | E | P | P | P | E | E. |
| B4 | 11 | 12 | 9 | | | 8 | 10 | 11 | | |
| C1 | N | N | N | N | N | N | N | N | N | N |
| | 23 | 22 | 23 | 23 | 22 | 23 | 23 | 23 | 22 | 22 |
| C4 | P | P | P | P | E | P | P | P | E | E |
| | 10 | 10 | 11 | 9 | | 9 | 8 | 10 | | |
| D1 | N | N | N | N | N | N | N | N | N | N |
| | 21 | 21 | 22 | 22 | 22 | 21 | 21 | 22 | 22 | 22 |
| D4 | P | P | P | E | E | P | P | P | E | E |
| | 10 | 9 | 9 | | | 10 | 13 | 11 | | |
| E1 | N | N | N | N | N | N | N | N | N | N |
| | 24 | 23 | 23 | 23 | 23 | 23 | 24 | 23 | 23 | 23 |
| E4 | P | P | P | E | E | P | P | P | E | E |
| | 10 | 11 | 10 | | | 10 | 9 | 11 | | |
| F1 | N | N | N | N | N | N | N | N | N | N |
| | 22 | 23 | 22 | 22 | 23 | 22 | 23 | 23 | 22 | 22 |
| F4 | P | P | P | E | E | P | P | P | E | E |
| | 11 | 10 | 9 | | | 9 | 12 | 11 | | |
| G1 | N | N | N | N | N | N | N | N | N | N |

TABLE 5 (c)-continued

| Sample | Al material: JIS 3003 (Al—Mn) Roughness: 0.02 μm | | | | | Roughness: 0.3 μm | | | | |
|---|---|---|---|---|---|---|---|---|---|---|
| | 21 | 21 | 22 | 22 | 22 | 22 | 22 | 21 | 21 | 22 |
| G4 | P | P | P | E | E | P | P | E | E | E |
| | 9 | 10 | 11 | | | 11 | 10 | | | |

Example 9

Photosensitive members A5, B5, C5, D5, E5, F5 and G5 were prepared in the same manner as the members A1, B1, C1, D1, E1, F1 and G1, respectively, which were obtained in Examples 1 to 3, except that the seventh layer was not provided. These photosensitive members A5 to G5 and those prepared in Examples 1 to 3, i.e. A1 to G1, were used for copying in different environments, i.e., at varying temperatures and varying humidities, and checked for the degree of disturbance in the copy images produced. The drum temperature is the same as the ambient temperature. The results are shown in Table 6, in which the symbols mean the following: N . . . no disturbance in images, that is, satisfactory images. P . . . partly disturbed images. E . . . entirely disturbed images.

Table 6 shows that no disturbance occurred in the images produced by the photosensitive members having the seventh layer.

TABLE 6

| Sample | Ambient temperature and humidity 20° C., 60% | 25° C., 70% | 30° C., 80% | 35° C., 80% | 35° C., 85% | 40° C., 85% |
|---|---|---|---|---|---|---|
| A1 | N | N | N | N | N | N |
| A5 | N | N | P | P | E | E |
| B1 | N | N | N | N | N | N |
| B5 | N | N | P | P | E | E |
| C1 | N | N | N | N | N | N |
| C5 | N | N | P | E | E | E |
| D1 | N | N | N | N | N | N |
| D5 | N | P | P | E | E | E |
| E1 | N | N | N | N | N | N |
| E5 | N | N | P | P | E | E |
| F1 | N | N | N | N | N | N |
| F5 | N | N | P | E | E | E |

Example 10

Photosensitive members A6–A9, B6–B9, C6–C9, D6–D9, E6–E9, F6–F9 and G6–G9 were prepared in the same manner as the members A1, B1, C1, D1, E1, F1 and G1, respectively, which were obtained in Examples 1 to 3, except that the flow rate of $B_2H_6$ was altered to vary the B content of the member. A1–G1 have an increasing B content toward the substrate as already stated. A6–G6 have a uniform B content over the entire coating. A7–G7 have an increasing B content toward the surface. A8–G8 have an increased B content toward the substrate and also toward the surface. A9–G9 have a decreased B content toward the substrate and also toward the surface.

TABLE 7

| Layer | A1–G1 $B_2H_6$ (sccm) | A1–G1 B/(si + Ge) (at. ppm) | A6–G6 $B_2H_6$ (sccm) | A6–G6 B/(Si + Ge) (at. ppm) | A7–G7 $B_2H_6$ (sccm) | A7–G7 B/(Si + Ge) (at. ppm) | A8–G8 $B_2H_6$ (sccm) | A8–G8 B/(Si + Ge) (at. ppm) | A9–G9 $B_2H_6$ (sccm) | A9–G9 B/(Si + Ge) (at. ppm) |
|---|---|---|---|---|---|---|---|---|---|---|
| 7th | 0 | 0 | 5 | 20 | 8 | 30 | 8 | 30 | 3 | 10 |
| 6th | 5 | 10 | 10 | 20 | 15 | 30 | 15 | 30 | 5 | 10 |
| 5th | 5 | 13 | 8 | 20 | 12 | 30 | 12 | 30 | 4 | 10 |
| 4th | 8 | 16 | 10 | 20 | 15 | 30 | 15 | 30 | 5 | 10 |
| 3rd | 20 | 20 | 20 | 20 | 20 | 20 | 20 | 20 | 20 | 20 |
| 2nd | 100 | 200 | 10 | 20 | 5 | 10 | 15 | 30 | 5 | 10 |

TABLE 7-continued

| | A1-G1 | | A6-G6 | | A7-G7 | | A8-G8 | | A9-G9 | |
|---|---|---|---|---|---|---|---|---|---|---|
| Layer | $B_2H_6$ (sccm) | B/(si + Ge) (at. ppm) | $B_2H_6$ (sccm) | B/(Si + Ge) (at. ppm) | $B_2H_6$ (sccm) | B/(Si + Ge) (at. ppm) | $B_2H_6$ (sccm) | B/(Si + Ge) (at. ppm) | $B_2H_6$ (sccm) | B/(Si + Ge) (at. ppm) |
| 1st | 100 | 200 | 10 | 20 | 5 | 10 | 15 | 30 | 5 | 10 |

The chargeability of the above photosensitive numbers was measured. The results are given in Table 8, which reveals that the members having an increasing B content toward the substrate are excellent in chargeability.

TABLE 8

| | V/μm | | V/μm | | V/μm | | V/μm | | V/μm | | V/μm | | V/μm |
|---|---|---|---|---|---|---|---|---|---|---|---|---|---|
| A1 | 22 | B1 | 23 | C1 | 23 | D1 | 21 | E1 | 24 | F1 | 23 | G1 | 21 |
| A6 | 11 | B6 | 12 | C6 | 12 | D6 | 10 | E6 | 12 | F6 | 11 | G6 | 8 |
| A7 | 5 | B7 | 6 | C7 | 5 | D7 | 5 | E7 | 7 | F7 | 6 | G7 | 5 |
| A8 | 6 | B8 | 7 | C8 | 6 | D8 | 5 | E8 | 7 | F8 | 6 | G8 | 6 |
| A9 | 3 | B9 | 3 | C9 | 3 | D9 | 2 | E9 | 3 | F9 | 3 | G9 | 2 |

What is claimed is:

1. A photosensitive member comprising:

an electrically conductive substrate;

a first layer region of amorphous silicon comprising a first layer which comprises carbon in an amount of from 5 to 60 atomic % and a Group IIIA impurity of the Periodic Table in an amount of from 100 to 1500 ppm and having a thickness of from 0.005 to 1.0 micron and a second layer formed on said first layer, said second layer comprising hydrogen and a Group IIIA impurity of the Periodic Table in an amount of from 100 to 1500 ppm and having a thickness of from 0.01 to 1 micron;

a second layer region of amorphous silicon formed on said second layer and comprising a third layer comprising hydrogen, oxygen in an amount of from $10^{-5}$ to 0.3 atomic % and a Group IIIA impurity of the Periodic Table in an amount of from 5 to 100 ppm and having a thickness of from 5 to 100 microns, the content of said second layer region Group IIIA impurity being less than that of said first layer region;

a third layer region of amorphous silicon comprising a fourth layer formed on said second layer region, said forth layer comprising hydrogen, oxygen in an amount of from $10^{-5}$ to 0.3 atomic % and a Group IIIA impurity of the Periodic Table in an amount of up to 30 ppm and being less than the amount of said third layer Group IIIA impurity and having a thickness of from 0.1 to 3.0 microns, a fifth layer formed on said fourth layer and comprising hydrogen, germanium in an amount of from 5 to 50 atomic %, oxygen in an amount of from $10^{-5}$ to 0.3 atomic % and a Group IIIA impurity of the Periodic Table in an amount of up to 15 ppm and having a thickness of from 0.1 to 3.0 microns, the content of said fifth layer Group IIIA impurity being less than that of said fourth layer, and a sixth layer formed on said fifth layer and comprising hydrogen, oxygen in an amount of from $10^{-5}$ to 0.3 atomic % and a Group IIIA impurity of the Periodic Table in an amount of up to 15 ppm and having a thickness of from 0.1 to 3.0 microns, the content of said sixth layer Group IIIA being the same or less than that of said fifth layer and the content of said third layer region Group IIIA impurity being less than that of said second layer region; and an overcoat layer of amorphous silicon formed on said third layer region and comprising hydrogen and carbon in an amount of from about 50 to 80 atomic % and having a thickness of from 0.05 to 1.5 microns.

2. A photosensitive member as claimed in claim 1 wherein said Group IIIA impurity of the Periodic Table comprises boron.

* * * * *